US007836521B2

(12) United States Patent
Winningham

(10) Patent No.: US 7,836,521 B2
(45) Date of Patent: Nov. 23, 2010

(54) SPORTS GLOVE HAVING FINGER KNUCKLE PROTECTION SYSTEM

(75) Inventor: Matthew M. Winningham, Royal Oak, MI (US)

(73) Assignee: Warrior Sports, Inc., Warren, MI (US)

( * ) Notice: Subject to any disclaimer, the term of this patent is extended or adjusted under 35 U.S.C. 154(b) by 500 days.

(21) Appl. No.: 12/051,230

(22) Filed: Mar. 19, 2008

(65) Prior Publication Data

US 2008/0244798 A1 Oct. 9, 2008

Related U.S. Application Data

(60) Provisional application No. 60/895,502, filed on Mar. 19, 2007.

(51) Int. Cl.
*A41D 19/00* (2006.01)

(52) U.S. Cl. ..... 2/161.1; 2/163

(58) Field of Classification Search ..... 2/16, 2/20, 21, 161.1, 161.6, 163
See application file for complete search history.

(56) References Cited

U.S. PATENT DOCUMENTS

| | | | |
|---|---|---|---|
| 2,293,347 | A | 8/1942 | Lindfield |
| 2,708,753 | A | 5/1955 | Kennedy |
| 2,831,196 | A | 4/1958 | Scheiber |
| 3,037,209 | A | 6/1962 | Applegate, Jr., et al |
| 3,387,306 | A | 6/1968 | Korey |
| 3,882,548 | A | 5/1975 | Shinagawa et al. |
| 4,094,014 | A | 6/1978 | Schroeder |
| 4,355,424 | A | 10/1982 | McCoy, Jr. |
| 4,411,024 | A | 10/1983 | Hayes |
| 4,484,359 | A | 11/1984 | Tirinen |
| 4,497,073 | A | 2/1985 | Deutsch |
| 4,519,097 | A | 5/1985 | Chappell, Jr. et al. |
| 4,570,269 | A | 2/1986 | Berlese |

(Continued)

FOREIGN PATENT DOCUMENTS

| | | |
|---|---|---|
| DE | 2842720 | 4/1980 |

(Continued)

OTHER PUBLICATIONS 1994-1995 STX Lacrosse Equipment Catalog, p. 8.

(Continued)

*Primary Examiner*—Katherine Moran
(74) *Attorney, Agent, or Firm*—Warner Norcross & Judd LLP

(57) ABSTRACT

A protective sports glove having a protective finger knuckle system introduced to the back portion of the finger portions to cover a space formed between adjacent pads corresponding to the knuckles of the fingers. The protective finger knuckle system includes a cap portion and a pair of side flanges that have a pair of slots. A strap is passed through the pair of slots on each of the pair of side flanges and beneath the cap portion and is secured to the glove. The cap portion spans the gaps between the protective portions of the fingers and the thumb and thus provide protection to the knuckles of the wearer where the fingers or thumb are flexed. Because the protective knuckle portion is not coupled to the pads defining the gap, they are maintained in position over the widening gap as the finger is flexed.

22 Claims, 3 Drawing Sheets

U.S. PATENT DOCUMENTS

| | | | |
|---|---|---|---|
| 4,662,006 | A | 5/1987 | Ross, Jr. |
| 4,677,698 | A | 7/1987 | Angas |
| 4,815,147 | A | 3/1989 | Gazzano et al. |
| 4,894,866 | A | 1/1990 | Walker |
| 4,894,868 | A | 1/1990 | Christopher |
| 4,930,162 | A | 6/1990 | Cote |
| 4,947,486 | A | 8/1990 | Hsuih |
| 4,984,300 | A | 1/1991 | Cho |
| 5,237,703 | A | 8/1993 | Brine et al. |
| 5,329,639 | A | 7/1994 | Aoki |
| 5,345,609 | A | 9/1994 | Fabry et al. |
| 5,390,372 | A | 2/1995 | Hashimoto et al. |
| 5,459,883 | A | 10/1995 | Garceau-Verbeck |
| 5,488,739 | A | 2/1996 | Cardinal |
| 5,511,243 | A | 4/1996 | Hall et al. |
| 5,548,844 | A | 8/1996 | Ceresia |
| 5,745,916 | A | 5/1998 | Linner |
| 5,781,929 | A | 7/1998 | Shikatani |
| 5,787,506 | A | 8/1998 | Wilder et al. |
| 5,946,720 | A | 9/1999 | Sauriol |
| 5,974,588 | A | 11/1999 | Furman |
| 5,983,396 | A | 11/1999 | Morrow et al. |
| 6,085,354 | A | 7/2000 | Wilder et al. |
| 6,122,769 | A | 9/2000 | Wilder et al. |
| 6,154,882 | A | 12/2000 | Ullman |
| 6,209,137 | B1 | 4/2001 | Wallick |
| 6,233,744 | B1 | 5/2001 | McDuff |
| D446,888 | S | 8/2001 | Morrow |
| 6,389,601 | B2 | 5/2002 | Kleinert |
| 6,405,380 | B1 | 6/2002 | Kuroda et al. |
| D462,146 | S | 8/2002 | Aoki |
| 6,453,474 | B2 | 9/2002 | Kleinert |
| 6,526,592 | B1 | 3/2003 | Best |
| 6,543,057 | B2 | 4/2003 | Beland et al. |
| 6,550,069 | B1 | 4/2003 | Morrow |
| 6,625,815 | B2 | 9/2003 | Litke |
| 6,681,402 | B1 | 1/2004 | Bevier et al. |
| 6,684,406 | B2 | 2/2004 | Fowler |
| 6,701,530 | B2 | 3/2004 | Kleinert |
| 6,813,780 | B2 | 11/2004 | Morrow |
| 6,959,453 | B2 | 11/2005 | Best |
| 7,000,256 | B2 | 2/2006 | Kleinert |
| 7,275,268 | B2 | 10/2007 | Gait |
| 7,370,373 | B2 | 5/2008 | Kohler |
| 2003/0014805 | A1 | 1/2003 | Morrow et al. |
| 2004/0010834 | A1 | 1/2004 | Sidlo |
| 2004/0060096 | A1 | 4/2004 | Thiruppathi |
| 2004/0093656 | A1 | 5/2004 | Morrow et al. |
| 2004/0123372 | A1 | 7/2004 | Kleinert |
| 2006/0107432 | A1 | 5/2006 | Cicero |
| 2007/0261149 | A1 | 11/2007 | Gait |
| 2008/0083048 | A1 | 4/2008 | Morrow et al. |
| 2008/0104737 | A1 | 5/2008 | Shepherd |
| 2008/0146981 | A1 | 6/2008 | Greenwald et al. |
| 2008/0178359 | A1 | 7/2008 | Grilliot et al. |
| 2008/0244799 | A1* | 10/2008 | Winningham ..... 2/16 |
| 2009/0222967 | A1* | 9/2009 | Winningham et al. ..... 2/21 |

FOREIGN PATENT DOCUMENTS

| | | |
|---|---|---|
| DE | 2843448 | 4/1980 |
| DE | 3135756 | 4/1983 |
| WO | WO03/013292 | 2/2003 |
| WO | WO2007/103985 | 9/2007 |

OTHER PUBLICATIONS

1987 Brine Lacrosse Catalog, pp. 12-13.
1983 Bacharach Rasin Lacrosse Catalog, p. 2.
1981 STX Catalog, page unknown.
1980 STX Lacrosse Catalog, page unknown.
1975 STX Lacrosse Catalog, p. 11.
Debeer, The Response, "Response" Glove, 2004.
Debeer, The Tropic, "Tropic" Glove, 2004.
Debeer, The Arctic, "Arctic" Glove, 2004.
Brine, "Winter" Glove, 2004.
Brine, "Performance" Glove, 2004.
Brine "Elite" Glove, 2004.
Brine "Element" Glove, 2004.
STX "Reflex" Glove, 2004.
STX "Winter" Glove, 2004.
STX "¾ Finger" Glove, 2004.

* cited by examiner

SPORTS GLOVE HAVING FINGER KNUCKLE PROTECTION SYSTEM

CROSS-REFERENCE TO RELATED APPLICATIONS

The present application claims priority from U.S. Provisional Patent Application Ser. No. 60/895,502, filed Mar. 19, 2007, and entitled "Sports Glove Having Protective Knuckle".

TECHNICAL FIELD

The present invention relates generally to a protective glove for use in contact sports, such as hockey or lacrosse. More particularly, the present invention relates to a protective sports glove having a finger knuckle protection system.

BACKGROUND OF THE INVENTION

In contact sports, such as lacrosse or hockey, where sticks are essential elements of the game, a player's hands, including their fingers and thumb, and wrists are especially vulnerable to injury when being checked by another player's stick. For this reason, players typically utilize padded or protective gloves to protect their hands, wrists and lower forearms during play.

Typical gloves for such contact sports generally include a hand portion coupled to a plurality of finger portions and a thumb portion. The hand portion, the finger portions, and the thumb portion each have a respective palm portion and a protective back with a plurality of protective portions such as pads, disposed thereon to provide protection to a wearer's hand from forces applied thereto during play. The gloves also may have a protective cuff or portion that is coupled to a lower edge of the hand portion and extends downwardly from the back portion to protect the wearer's wrist and forearm. The protective back portions of the hand portion, the plurality of finger portions and the thumb portion are formed in such a way so as to allow them to flex during play, in a manner corresponding to a wearer's hand, finger or thumb without significantly impacting the protection provided thereto.

One issue with gloves of this type is the degree of protection from impact provided to the wearer during usage. Foam padding or other protective structures on the outer portions of the gloves generally provide an adequate amount of relief from impact due to a stick, ball or puck. The amount of protection depends primarily upon the thickness and composition of the padding as well as the angle of impact of the device contacting the glove. In order to provide flexibility to the wearer's fingers, gloves are typically provided with flex or break lines between adjacent pads that are located over the respective knuckles of the fingers and thumb to accommodate increased movement of the wearer's fingers and thumb. Flex or break lines are also provided in the back of the hand for increased flexibility such that a glove is allowed to accommodate movement of a wearer's hand.

While these gloves have increased protection, it is known that to provide increased flexibility, flex or break lines are provided in the glove. Thus, when a wearer flexes his fingers around the stick or otherwise flexes their hand, a gap is created between the adjacent pads in the area of the knuckles and exposes the knuckle making it particularly vulnerable to impact from a stick, ball or puck. Such impact can result in a serious injury to a wearer's fingers or thumb. Thus, there exists a need for a protective sports glove that provides protection to the knuckles or other exposed areas of a player's hand of the fingers during usage, regardless of the amount of flex of the fingers, yet does not affect the degree of flex of the fingers during that same usage.

SUMMARY OF THE INVENTION

Accordingly, it is an advantage of the present invention to provide a protective sports glove that yields increased protection to the knuckles of the fingers of a wearer without adversely affecting the degree of flex or movement of the wearer's fingers during play.

It is another advantage of the present invention to provide a protective finger knuckle system for a protective sports glove that covers any gap or space created between adjacent protective portions of the finger when a glove is flexed by a wearer during play.

In accordance with the above and the other advantages of the present invention, a protective finger knuckle system for a protective sports glove is provided. The glove includes a protective knuckle system disposed on the outside or back portion of the glove on one or more of the finger portions. The protective knuckle system is located in the space between adjacent protective portions which generally corresponds to the knuckles of the fingers. The protective finger knuckle system is coupled to the glove and includes a cap portion and a pair of side flanges. The side flanges have a pair of slots. The cap portion is made of an impact resistant material, such as plastic or metal that protects a wearer's knuckle. A strap, preferably an elastic strap, is feathered through the pair of slots on each of the pair of side flanges and beneath the cap portion. Each end of the strap is secured to the glove to assist in retaining the protective finger knuckle system.

The cap portion spans the gaps, corresponding to the flex lines, between the adjacent protective portions of the fingers and the thumb and thus provides protection to the knuckles of the wearer when the fingers or thumb are flexed. Because the protective knuckle portion is not coupled to the pads that move to create the gap, the cap portion is maintained in position over the widening gap as the finger is flexed. The knuckle protection system thus allows the finger to flex and unflex freely without restriction and without compromising protection as it covers the open space between adjacent pads and overlies the knuckle throughout the full range of wearer movement.

These and other features and advantages of the present invention will become apparent from the following description of the invention, when viewed in accordance with the accompanying drawings and appended claims.

DETAILED DESCRIPTION OF THE PREFERRED EMBODIMENT

Referring now to the Figures, which illustrate a protective sports glove 10 in accordance with the present invention. While the drawings illustrate the right hand glove, it will be understood that the left hand glove has the same configuration, but opposite orientation and thus need not be described separately. The disclosed glove 10 is preferably for use in the game of hockey. However, it will be understood by one of ordinary skill in the art that the disclosed glove 10 may be used in a variety of other contact stick sports, including lacrosse. Additionally, the protective sports glove may have a variety of other suitable uses.

Figure 1:
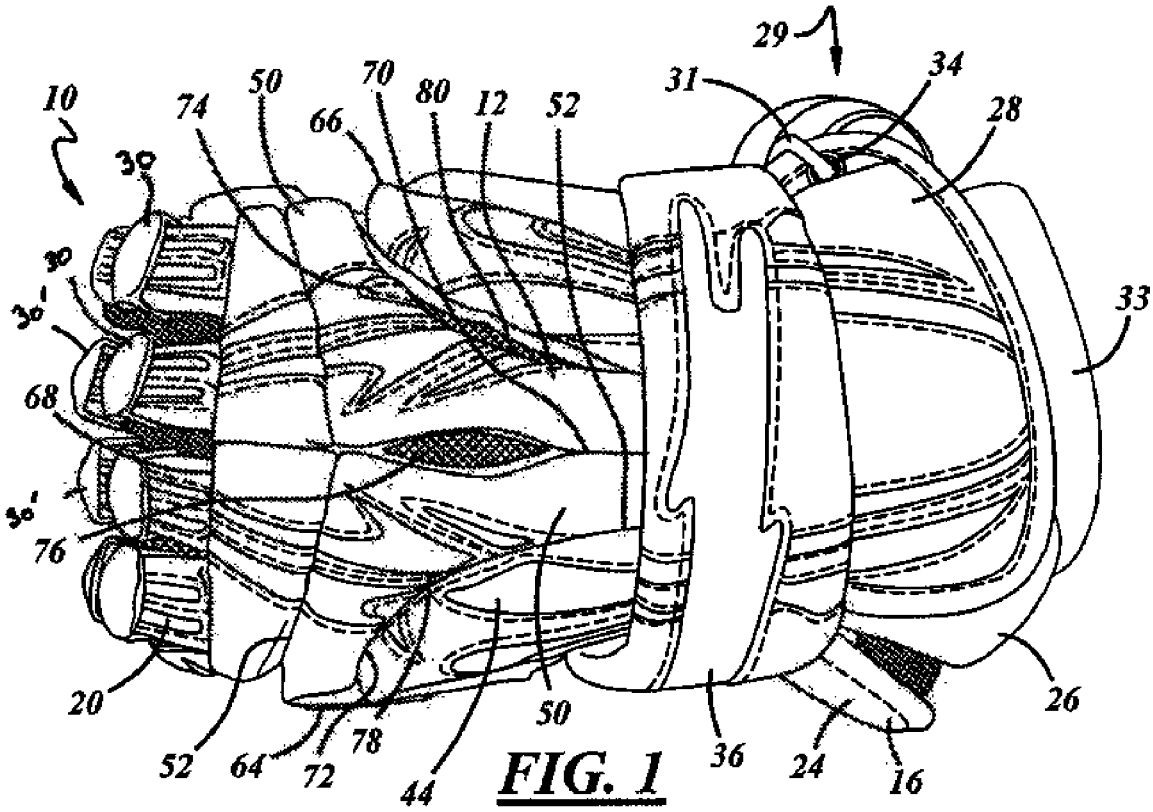
FIG. 1 is a top backside view of a protective sports glove with a protective knuckle system in an unflexed position in accordance with a preferred embodiment of the present invention.
Figure 2:
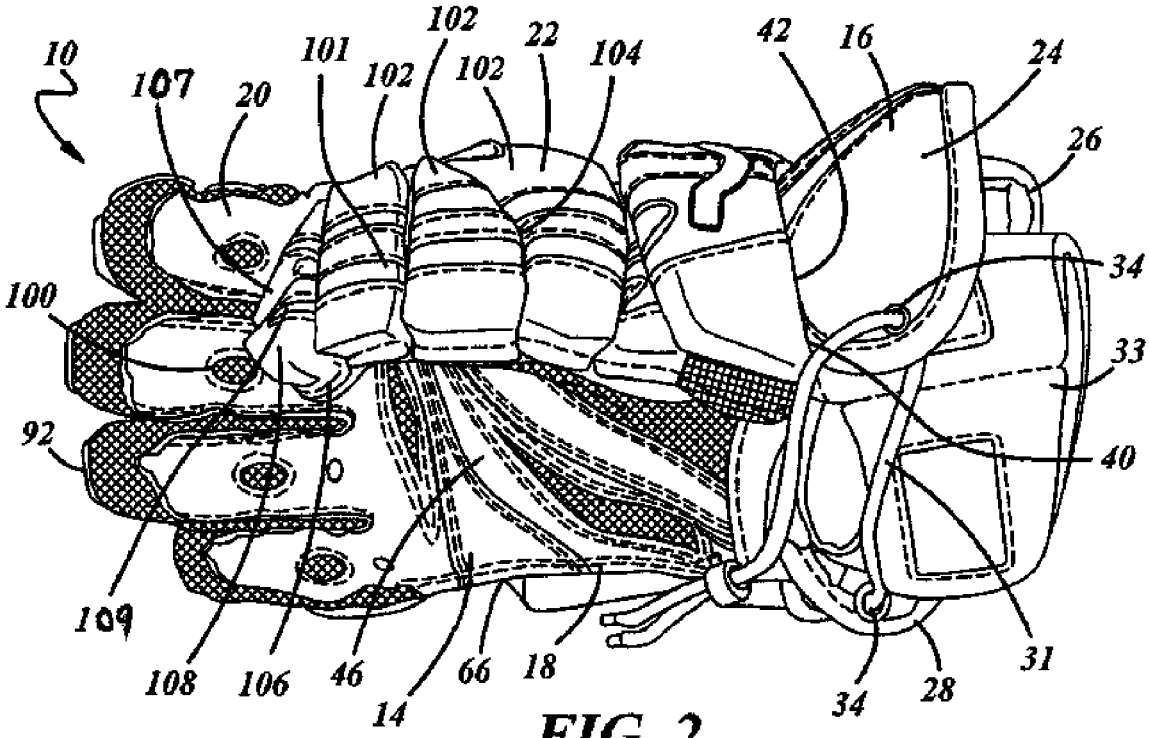
FIG. 2 is a bottom palmside view of the protective sports glove of FIG. 1.
Figure 3:
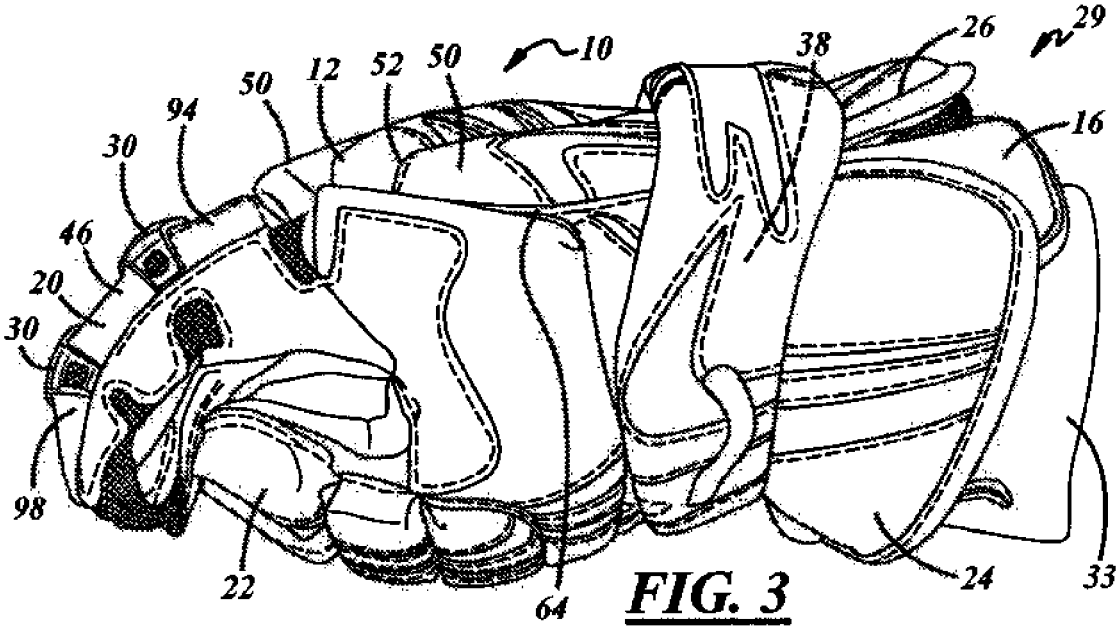
FIG. 3 is a side view of the thumb side of the protective sports glove of FIG. 1.

Referring now to FIGS. 1 through 3, the glove 10 has a top (backside) portion 12 and a bottom (palmside) portion 14 which therebetween define an interior space for receipt of a wearer's hand. The glove 10 generally has a cuff portion 16, a hand portion 18 coupled to the cuff portion 16, a plurality of finger portions 20 extending from the hand portion 18, and a thumb portion 22 also extending from the hand portion 18. In one embodiment, the cuff portion 16 includes a floating subcuff portion 33 disposed within and coupled to the cuff portion 16. One or more of the finger portions 20 includes at least one protective finger knuckle system 30, 30' as discussed in more detail below in FIGS. 4A-C, 5 and 6.

The cuff portion 16 preferably has a first cuff portion 24, a second cuff portion 26, and a third cuff portion 28. The first cuff portion 24, the second cuff portion 26, and the third cuff portion 28 are secured at an upper border located near the hand portion 18. The first cuff portion 24, the second cuff portion 26, and the third cuff portion 28 each have an edge that preferably overlaps the opposing edge of an adjacent cuff portion 24, 26, 28 to provide both maximum flexibility and protection. Specifically, the overlapping edge portions of the cuff portions 24, 26, 28 yields a split cuff, as generally indicated by reference number 29. The cuff portions 24, 26, 28 are designed to cover and protect substantial portions of a wearer's wrist and forearm. The overlapping (split cuff) configuration of the cuff portions 24, 26, 28 provides added protection to a wearer's wrist and forearm because of the double layer of padding. Additionally, since the cuff portions 24, 26, 28 can move with respect to one another, they provide increased flexibility for a wearer's wrist as it moves during play. For example, the overlapping configuration of the cuff portions 24, 26, 28 allow them to move as a wearer's hand flexes and not open any undesirable gaps that would expose a wearer to injury. As will also be understood by one of ordinary skill in the art, a split cuff portion without overlapping portions or edges, but instead are simply aligned edge to edge, may also be employed. Further, the cuff portion 16 can also be formed of a single structure or multiple structures secured together.

As shown in one embodiment, the first cuff portion 24 and the third cuff portion 28 do not extend entirely around the wearer's wrist and are connected by a lace 31 that passes through openings 34 in each of the cuff portions. Alternatively, the cuff portion 16 can consist of either a single or multiple pieces that extend entirely around a wearer's wrist, as will be readily understood by one of ordinary skill in the art. Other securing mechanism besides lace may also be employed.

The floating subcuff portion 33 is substantially contained within the cuff portion 16. The subcuff portion 33 is secured to the inner side of the first cuff portion 24 using an elastic member (not shown) and to the inner side of the third cuff portion 28 using another elastic member (not shown). It will be understood that the subcuff portion 33 can be attached to the cuff portion 16 in a variety of different ways, i.e. more or less elastic straps, or other compliant material or at a variety of different locations. Alternatively, the subcuff portion 33 can be flexibly attached to other portions of the glove 10. A preferred subcuff portion 33 utilized in the present invention is described in U.S. patent application Ser. No. 10/904,445, and entitled "Protective Sports Glove with Floating Cuff Portion", which claims priority from U.S. Provisional Patent Application No. 60/518,772 filed Nov. 10, 2003, the disclosure of which are herein incorporated by reference.

Additionally, a wrist guard 36 is preferably coupled to the glove 10 such that it covers the space 38 between the bottom edge 40 of the hand portion 18 and the upper edge 42 of the cuff portion 16 as a wearer's hand moves and flexes during play to provide increased protection. The wrist guard 36 can be attached to the hand portion 18 or the cuff portion 16 or both and can be secured thereto by a variety of other suitable ways. Alternatively, the wrist guard 36 may be disposed within the interior space of the glove 10 to cover the space 38 from below the top portion 12.

The hand portion 18 extends generally between the space or gap 38 and the finger portions 20 and has a rear portion 44 and a palm portion 46. The rear portion 44 preferably has a plurality of protective portions 50, such as padded portions, secured thereto to provide protection to a wearer's hand. However, protective portions constructed of other suitable material, such as plastic or rubber, may also be utilized. As shown, the rear portion 44 is preferably subdivided into a plurality of protective portions 50 that are sewn to an outer material 99 or liner, such as a cloth material or the like. It will be appreciated that the protective portions 50 can be secured to the glove in a variety of other suitable ways. Each pair of protective portions 50 define a flex or break line 52 there between, which allow the glove 10 to move as a wearer's hand moves to provide better fit and comfort.

The protective portions 50 terminate at a junction 68 located generally between the hand portion 18 and the finger portions 20. The junction 68 allows the finger portions 20 to move and flex with respect to the adjacent protective portions 50 as the junction 68 is generally disposed over a wearer's knuckle area, allowing the finger portions 20 to move as a wearer's fingers flex. Additionally, the rear portion 44 has a vertical flex or break line 70 that extends generally from the cuff portion 16 to the junction 68 and allows protective portions on either side thereof to move respect to one another. The vertical flex or break line 70 allows the glove to fit more comfortably as it allows the glove to better conform to a wearer's hand as he closes his hand around a stick and, therefore, provide a tighter shape. This is desirable as the back of a typical wearer's hand is not flat, and the protective portions are not flexible enough to bend without the vertical flex or break line 70.

The rear portion 44 of the hand portion 18 also preferably has a pair of opposing angled flex or break lines 72 and 74, which begin generally at the base of the hand portion 18 adjacent the space 38 and extend generally outward to a respective side 64, 66 of the hand portion 18. The angled flex or break lines 72, 74 similarly assist the glove 10 in conforming to the wearer's hand as the protective portions 50, 56 can each independently move with respect to the other protective portions as a wearer's hand flexes during play, thus providing a better fitting glove with increased flexability. The rear portion 44 may have a variety of additional or different flex lines as desired.

In a preferred embodiment, the rear portion 44 of the hand portion 18 has a plurality of vent openings formed therein to provide ventilation to a wearer's hand. A vent opening 76 is preferably disposed along the vertical flex line 70. A vent opening 78 is preferably disposed along the first angled flex line 72. Another vent opening 80 is preferably disposed along the second angled flex line 74. The vent openings 76, 78, 80 provide ventilation to a wearer's hand by allowing air to circulate into the glove interior. It should be understood that while three vent openings 76, 78, 80 are disclosed on the rear portion 44 of the glove 10, any number of vent openings may be utilized. Additionally, the vent openings may be disposed in a variety of other locations along the rear portion 44 in accordance with the preferred embodiment, including within or through the respective individual protective portions themselves, instead of along the flex or break lines.

Referring now to the plurality of finger portions 20, which extend generally from the junction 68 to a respective tip 92. The finger portions 20 each include a plurality of protective portions 94, 96, 98 that are sewn into a durable cover material 99 or liner. Each of the plurality of protective portions 94, 96, 98 on one or more of the finger portions 20 is separated by a gap 97, space or break in the protective portions. In accordance with a preferred embodiment, a protective finger knuckle system 30, 30' as will be described in further detail below in connection with FIGS. 4A-C and 5-6 is disposed in each gap 92. It will be understood that more, or less, protective portions may be included or utilized on each finger portion 20, as desired.

The thumb portion 22 has a plurality of protective portions 102 formed thereon that extend to its tip portion 100. In the preferred embodiment shown in FIGS. 1-3, each protective portion 102 is separated by a generally horizontal flex or break line 104. The protective portion 106, which is positioned near the tip of the thumb portion 22, is preferably sub-divided into a first part 108 and a second part 107 by a substantially vertical flex or break line 109. it will be understood that the number of protective portions, and corresponding horizontal and vertical flex or break lines, on the thumb portion 22 can take on a variety of different configurations.

Figure 4A:
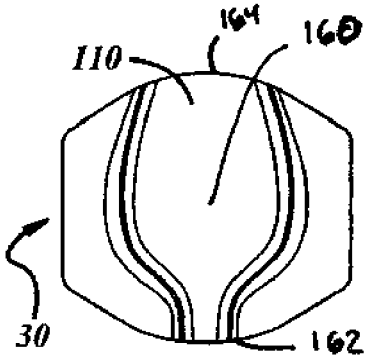
FIG. 4A is a top view of a portion of a protective knuckle system in accordance with a preferred embodiment of the present invention.
Figure 4B:
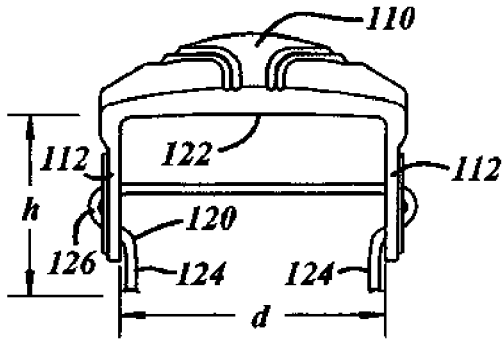
FIG. 4B is a front side view of the portion of the protective knuckle system and strap of FIG. 4A.
Figure 4C:
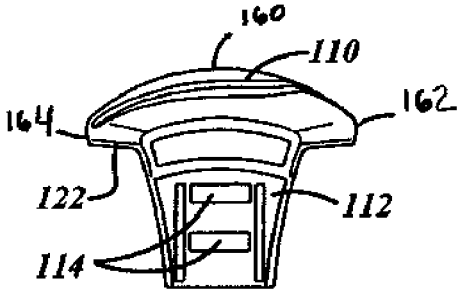
FIG. 4C is a side view of the portion of the protective knuckle system of FIG. 4A.

Referring now to FIGS. 4A-4C, one preferred embodiment of the finger knuckle protective portion 30 is illustrated. The finger knuckle protective portion 30 is disposed in the gap 97 between adjacent protective portions in one of the finger portions 20 and is designed to cover the gap 97 as the finger flexes throughout its full range of movement. The finger knuckle protective portion 30 includes a cap portion 110 and a pair of side flanges 112 that extend generally downwardly and perpendicularly from the cap portion 110. The cap portion 110 is generally dome-shaped such that it has an apex 160. The cap portion 110, as shown, includes a pair of side portions 161, a rounded front 162 and a rounded back 164. The cap portion 110 is preferably constructed of an impact-resistant material, such as plastic, rubber or metal, that provides protection to a wearer's finger knuckle. Other suitable materials may also be utilized. Due to the dome-shaped configuration, the thickness of the cap portion 110 can vary such that the thickest part of the cap portion is at the apex 160, which is the portion that provides the most impact resistance. Further, the dome-shape assists in dispersing the force of the blow imparted thereto. It will be understood that the cap portion 110 can have a variety of different shapes and configurations.

Each of the side flanges 112 extends generally downwardly and includes a pair of slots 114 formed on each side. One of the slots is an upper slot and one is a lower slot. More or less slots, or slots having varying configurations, may also be employed. Each of the upper slot and the lower slot receives an elastic strap 120 threaded or passed therethrough to secure the knuckle finger protection system 30 to the glove 10. Each end of the strap 120 is secured to the finger portion 20 such that the strap passes through both slots on one side (FIG. 5), spans the space between the side flanges 112 (FIG. 4B), and engages the slots on the other side flange 112.

Figure 5:
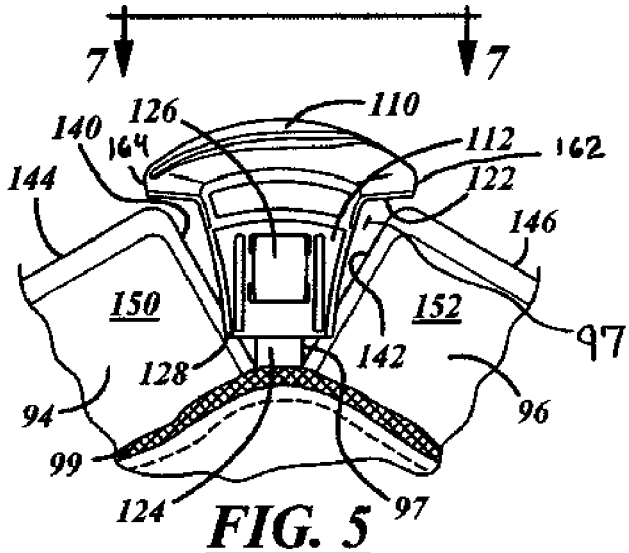
FIG. 5 is a schematic side view of the finger portion and the protective knuckle system of FIG. 1 in a flexed position in accordance with a preferred embodiment of the present invention.
Figure 6:
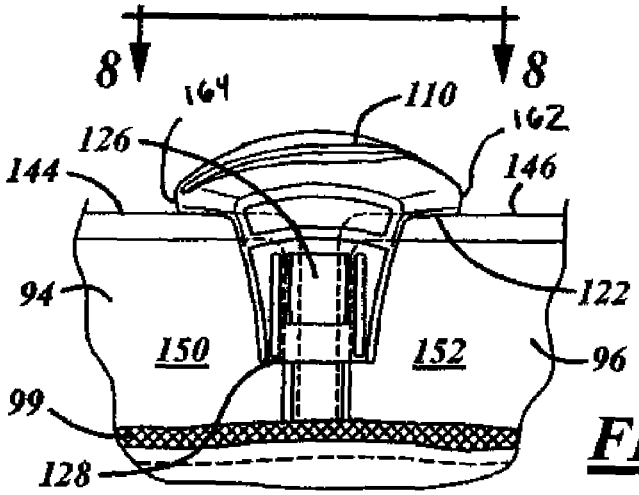
FIG. 6 is a schematic view of a protective glove with the protective knuckle system of FIG. 5 in an unflexed position in accordance with a preferred embodiment of the present invention.

As best shown in FIGS. 5 and 6, each end 124 of the strap 120 is secured to the cover material 99 of the finger portion 20 of the glove 10 by sewing, gluing or some other securing method well known to those of ordinary skill in the art. Preferably, as shown in FIGS. 5 and 6, the ends 124 of the strap 120 are sewn to the cover material 99 or liner along a side portion or within the gaps 97 between the respective padded portions 94, 96 or 96, 98. The strap can consist of a variety of other suitable materials. Further, the strap can be formed of multiple pieces. Also, more or less slots may be formed in each side flange 112 as desired.

As shown, the finger knuckle protective portion 30 is sized to cover the entire gap 97. Specifically, the side flanges 112 have inside portions 128 that are spaced apart a distance (d) that is slightly greater than the width of the corresponding protective portions 94, 96, 98 of the finger portions 20. Thus, the inside portions 128 are disposed outwardly from the outside surface of the protective portions and preferably contact the other side thereof. Additionally, the height (h) of the side flanges 112 from its base 129 to the underside 122 of the cap portion 110 is positioned such that it is slightly greater than and is configured such that the underside 122 of the cap portion 110 is slightly above the upper surface of the protective portions 94, 96, 98. Additionally, the rounded front 164 and the rounded back 166 of the cap portion 110 are sized to extend and overlap the protective portions in the unflexed position and still substantially cover the gap 97 in the flexed position.

The cap portion 110 spans the gap 97, corresponding to the die cuts or flex lines, between the protective portions 94, 96 or 96, 98 of the finger portions 20 and thus provide protection to the finger knuckles of the wearer where the fingers are flexed. Because the protective finger knuckle portion 30 is not coupled to the pads 94, 96 or 96, 98 defining the gap 97, the protective finger knuckle portion 30 is maintained in position over the widening gap 97 as the finger is flexed. The finger knuckle protection system 30 thus allow the fingers to flex and unflex freely without restriction and without compromising protection. A protective finger knuckle portion 30, 30' is preferably disposed in each of the gaps 97 between the padded portions 94, 96 and the padded portions 96, 98. It will be understood that more or less finger knuckle portions may be utilized as desired.

Figure 7:
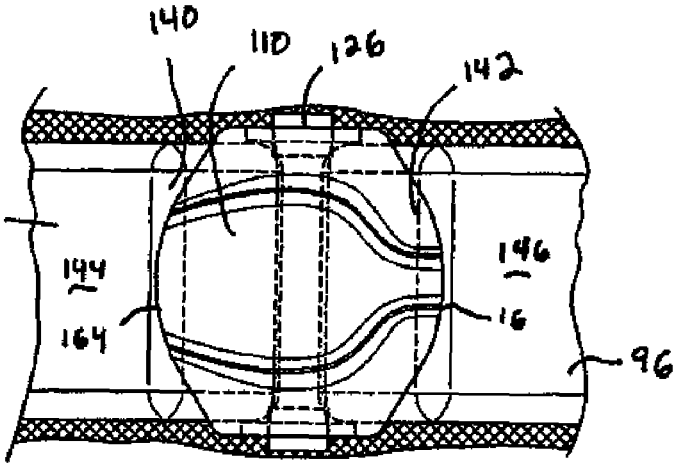
FIG. 7 is a schematic top view of the finger portion and the protective knuckle system of FIG. 1 in a flexed position in accordance with a preferred embodiment of the present invention.

Referring now to FIGS. 5 through 8, which illustrate one finger portion 20 utilizing the protective finger knuckle system 30 in a flexed and unflexed position. In the flexed position, as shown in FIGS. 5 and 7, the strap 120 is taught enough to maintain the cap portion 110 in a position directly over the widening gap 97 between the end portions 140, 142 of the adjacent protective portions (shown here as protective portions 94, 96, but could also define the gap 97 between protective portions 96, 98 or any other gap). Thus, any impacting blow from a stick or the like towards the widening gap 97 will contact the cap portion 110, and not the exposed gap 97 between the respective padded portions 94, 96 or 96, 98, therein providing additional protection to the underlying finger knuckle positioned within the finger portion 20 of the glove 10.

Figure 8:
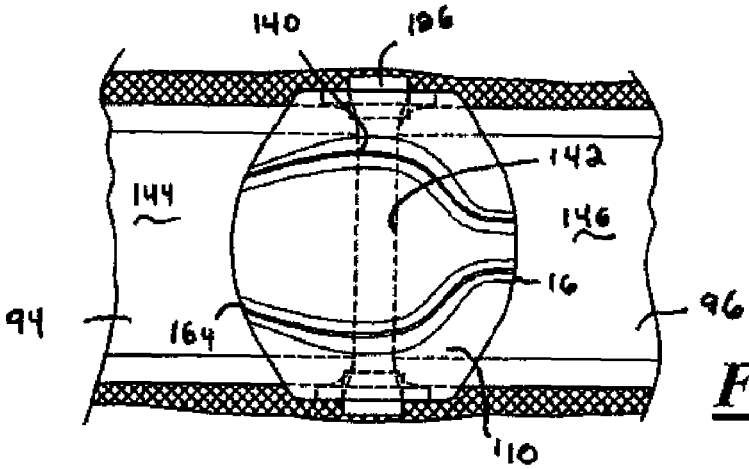
FIG. 8 is a schematic top view of the finger portion and the protective knuckle system of FIG. 7 in an unflexed position in accordance with a preferred embodiment of the present invention.

In the unflexed position, as shown in FIGS. 6 and 8, the finger is generally straight. The term generally straight also recognizes that most protective sports gloves have some curvature to the fingers in an unflexed position, see e.g., FIG. 4. In this position, the end portions 140, 142 are generally aligned and in close proximity to one another, therein minimizing the gap 97 there between. The finger knuckle protective portion 30 is positioned such that the underside 122 of the cap portion 110 and the middle portion 126 of the strap 120 between the ends 124 and beneath the underside 122 are positioned above the top portions 144, 146 of the padded portions 94, 96. In addition, the inside portion 128 of the side flanges 112 is positioned outside of the respective side portions 150, 152 of the padded portions 94, 96 in the unflexed position.

While the present invention is directed to a finger knuckle protective system, a similar knuckle protective system could also be fashioned for use on a protective sports glove to protect a wearer's thumb knuckles. Moreover, while the protective sports glove is primarily used in the games of hockey and lacrosse, a protective glove having the finger knuckle protective system of the present invention could be utilized in other sports in which impacting blows to the hand may occur. In addition, the finger knuckle protective system could be utilized on non-sports related protective gloves.

While particular embodiments of the invention have been shown and described, numerous variations or alternate embodiments will occur to those skilled in the art. Accordingly, it is intended that the invention be limited only in terms of the appended claims.

What is claimed is:

1. A protective sports glove, comprising:

a hand portion comprising an inner palm portion and an opposing backside portion;

a thumb portion secured to and extending from said hand portion for receipt of a wearer's thumb therein, said thumb portion including a thumb palm portion and an opposing padded thumb portion; and a plurality of finger portions secured to and extending from said hand portion for receipt of a wearer's fingers therein, each of said plurality of finger portions including a finger palm portion and an opposing backside portion;

a plurality of protective portions formed on said backside portion of at least one of said plurality of finger portions, wherein a gap is formed between at least two protective portions and wherein the size of said gap increases as a wearer flexes said finger portion and decreases as the wearer unflexes said finger portion;

a protective finger knuckle portion in communication with said gap to provide protection to a wearer's knuckle as the glove flexes;

wherein said protective finger knuckle portion includes a cap that substantially overlies said entire gap as the wearer flexes and unflexes said finger portion.

2. The protective sports glove of claim 1, wherein said cap includes at least two side flanges extending down toward said finger portion.

3. The protective sports glove of claim 2, wherein said side flanges include at least one slot adapted to receive a strap that is secured to said finger portion to retain said protective finger knuckle portion to said protective sports glove.

4. The protective sports glove of claim 3, wherein said side flanges are positioned to extend from opposite sides of said cap, wherein said strap travels through at least one of said slots in each of said side flanges and is connected to said finger portion at each of said opposite sides of said cap.

5. The protective sports glove of claim 4, wherein said strap is sewn to a cover material on said finger portion.

6. The protective sports glove of claim 1, wherein said cap is adapted to at least partially overlie a portion of at least one of said protective portions.

7. The protective sports glove of claim 6, wherein said cap is positioned centered over said gap in said flexed and unflexed positions.

8. The protective sports glove of claim 2, wherein said side flanges are sewn to said finger portion.

9. The protective sports glove of claim 1, wherein said cap is generally dome shaped and has an apex.

10. The protective sports glove of claim 9, wherein said apex is thicker than the remaining portions of said cap.

11. The protective sports glove of claim 1, wherein said cap is formed from an impact resistant material.

12. The protective sports glove of claim 10, wherein said cap is formed from at least one of plastic, rubber and metal.

13. A protective sports glove, comprising:

a hand portion comprising an inner palm portion and an opposing backside portion;

a thumb portion secured to and extending from said hand portion for receipt of a wearer's thumb therein, said thumb portion including a thumb palm portion and an opposing padded thumb portion;

a plurality of finger portions secured to and extending from said hand portion for receipt of a wearer's fingers therein, each of said plurality of finger portions including a finger palm portion and an opposing backside portion and opposing first and second sides;

a plurality of protective portions formed on said backside portion of at least one of said plurality of finger portions, wherein a gap is formed between at least two of said protective portions at a knuckle section of said finger portion;

a protective finger knuckle portion joined with said finger portion over said gap to provide protection to a wearer's knuckle as the glove flexes, said protective finger knuckle portion including a cap that both at least partially overlies said at least two protective portions when a wearer unflexes said finger portion, and that covers said gap when a wearer flexes said finger portion, said cap including at least two side flanges extending toward said finger portion at opposite sides of said cap, said cap extending from the first side to the second side of the finger portion.

14. The protective sports glove of claim 13, wherein said side flanges are secured to said finger portion, wherein said side flanges define a width, wherein the cap includes a front and a back, wherein the front and back of the cap extend beyond the width of the flanges in an overhanging manner.

15. The protective sports glove of claim 13, wherein each of said side flanges is joined with an element, the element being joined with said finger portion to retain said protective knuckle portion in a position over at least a portion of said gap.

16. The protective sports glove of claim 13, wherein the size of said gap increases as the wearer flexes said finger portion to a flexed position and decreases as the wearer unflexes said finger portion to an unflexed position, wherein said cap is generally centered and over said gap in the flexed and unflexed positions.

17. A protective sports glove, comprising:

a hand portion;

a digit portion secured to and extending from said hand portion for receipt of a wearer's digit therein, said digit portion including a digit palm portion, and an opposing backside portion, a first side, and a second side opposite said first side;

a first protective portion and a second protective portion positioned on said backside portion of said digit portion, said first protective portion and said second protective portion separated by a gap that corresponds to at least one digit joint of a wearer, the gap widening and narrowing when a wearer flexes and unflexes the wearer's digit, respectively; and a protective digit knuckle portion secured to said digit portion over said gap to provide protection to a wearer's knuckle as the glove flexes, said protective digit knuckle portion including a side flange joined with said digit portion and extending upwardly along at least a portion of said protective portion, the side flange joined with a cap, the cap configured to cover at least a portion of at least one of said first and second protective portions when the wearer unflexes said digit portion, the cap also configured to cover at least a portion of said gap when the wearer flexes said digit portion.

18. The protective sports glove of claim 17, wherein said side flange is disposed and adjacent, but not in, said gap.

19. The protective sports glove of claim 18, comprising at least two side flanges extending toward said digit portion adjacent opposite sides of said protective portions, wherein said side flanges on each side of said protective portions are joined with the digit portion at a bottom portion of said side flanges.

20. The protective sports glove of claim 19, wherein said bottom portion of said side flanges is secured to said digit portion to retain said protective digit knuckle portions over said gap.

21. The protective sports glove of claim 17 wherein said cap is dome-shaped, and includes a front and a back, the front configured to be adjacent said first protective portion, and the back configured to be adjacent the second protective portion.

22. The protective sports glove of claim 17 wherein said side flange includes a width, wherein said cap includes a front and a back, the front and back outwardly projecting beyond the width of the side flange.

* * * * *